US007198146B2

(12) United States Patent
Guidetti

(10) Patent No.: US 7,198,146 B2
(45) Date of Patent: Apr. 3, 2007

(54) DEVICE AND METHOD FOR FORMING GROUPS OF PRODUCTS IN CONVEYING SYSTEMS, IN PARTICULAR FOR AUTOMATIC PACKAGING MACHINERY

(75) Inventor: Dario Guidetti, Grignasco (IT)

(73) Assignee: Cavanna S.p.A., Prato Sesia (IT)

( * ) Notice: Subject to any disclaimer, the term of this patent is extended or adjusted under 35 U.S.C. 154(b) by 39 days.

(21) Appl. No.: 11/182,431

(22) Filed: Jul. 15, 2005

(65) Prior Publication Data

US 2006/0016729 A1 Jan. 26, 2006

(30) Foreign Application Priority Data

Jul. 15, 2004 (EP) ..... 04425527

(51) Int. Cl.
*B65G 47/26* (2006.01)

(52) U.S. Cl. ..... 198/428; 198/418.7; 198/493

(58) Field of Classification Search ..... 198/493, 198/418.7, 428, 418.8; 414/798.1, 798.2
See application file for complete search history.

(56) References Cited

U.S. PATENT DOCUMENTS 4,180,153 A * 12/1979 Krishnan et al. ..... 198/418.7
5,501,061 A * 3/1996 Easter ..... 198/493
5,785,169 A * 7/1998 Egger ..... 198/493
5,893,701 A 4/1999 Pruett ..... 414/798.2
5,915,523 A * 6/1999 Spatafora ..... 198/461.3

FOREIGN PATENT DOCUMENTS

EP 1304303 A1 4/2003
GB 1152333 5/1969

OTHER PUBLICATIONS

Partial European Search Report for European Application No. 04425527.1, dated Jun. 24, 2005.
U.S. Appl. No. 11/182,561, filed Jul. 15, 2005; Applicant: Guidetti; Title: Device and Method for Forming Groups Composed by a Variable Number of Products.

* cited by examiner

*Primary Examiner*—James R. Bidwell
(74) *Attorney, Agent, or Firm*—Heslin Rothenberg Farley & Mesiti P.C.; Victor A. Cardona, Esq.

(57) ABSTRACT

A device for forming groups of products in conveying systems, in particular for automatic packaging machinery, includes a path of conveyance in which, in operation, an array of products advances along a direction of conveyance with the products in contact with each other. A separator element is able to be inserted in a predetermined area of the conveyance path to separate a group of products downstream of the separator element with a predetermined dimension in the direction of advance. At least one nozzle is arranged to emit at least one jet of gas, such as air, on the array of products to distance the products at least partially from each other in the predetermined area before inserting the separator element.

20 Claims, 4 Drawing Sheets

DEVICE AND METHOD FOR FORMING GROUPS OF PRODUCTS IN CONVEYING SYSTEMS, IN PARTICULAR FOR AUTOMATIC PACKAGING MACHINERY

CROSS-REFERENCE TO RELATED APPLICATIONS

This application claims priority from European Patent Application No. 04425527.1, filed on Jul. 15, 2004, the entire disclosure of which is incorporated herein by reference.

BACKGROUND OF THE INVENTION

The present invention relates in general to devices for conveying products and it was developed with particular attention to its use within automatic packaging machinery.

More in particular, the invention relates to the techniques that allow to form groups of products, in particular food products such as biscuits or the like, to obtain packages, each containing a predetermined quantity of products. This possible application, whereto reference shall be made hereafter, must not in any case be construed to limit in any way the scope of the invention.

The invention was developed in particular for an installation for the production of packages formed by a certain quantity of products, mutually stacked or set side by side. Usually, the individual products destined to be grouped are carried to the inlet of a packaging station in the form of a continuous array of stacked or side by side products. To obtain the package, therefore, it is necessary to subdivide the continuous array of products advancing along a direction of conveyance with the products in mutual contact into groups of products distanced from each other at regular intervals.

To fix ideas, one can consider biscuits having flattened shape, mutually superposed to form a stack wherefrom blocks or packs (usually called "slugs") are to be obtained, each to be inserted in a package or part of a package.

In traditional solutions adopted in the prior art to perform this function, an array of products is made to advance along a conveyance path with the products in mutual contact and cyclically to insert in the array, in a predetermined area of the conveyance path, a separator element (for example shaped as the blade of a knife, in order to separate from the array successive groups of products downstream of the separator element.

The insertion of a separator element between two products in mutual contact in a continuous array is a delicate operation, especially in the case of oven-baked products such as biscuits or the like with irregular surfaces and subject to ample dimensional tolerances. The insertion of the separator element could cause the rupture of a product if, for example due to the irregular dimensions of the products, one of the products is positioned on the trajectory of insertion of the separator element.

The insertion of a separator element between two products in mutual contact in a continuous array is an operation that can become even more critical if the products have a convex face and a concave shape and are stacked or set mutually side by side with the concave face of a product in contact with the convex face of the immediately subsequent or preceding product. In such cases, the risk of rupture of a product during the insertion of a separator element is very high.

The object of the present invention is to provide a device and a method for forming groups of products which allow to overcome the aforesaid drawback.

According to the present invention, said object is achieved by a device and by a method having the characteristics set out in the claims.

BRIEF DESCRIPTION OF THE DRAWINGS

The characteristics and advantages of the present invention shall become readily apparent in the detailed description that follows, provided purely by way of non limiting example, with reference to the accompanying drawings, in which.

DETAILED DESCRIPTION OF THE DRAWINGS

Figure 1:
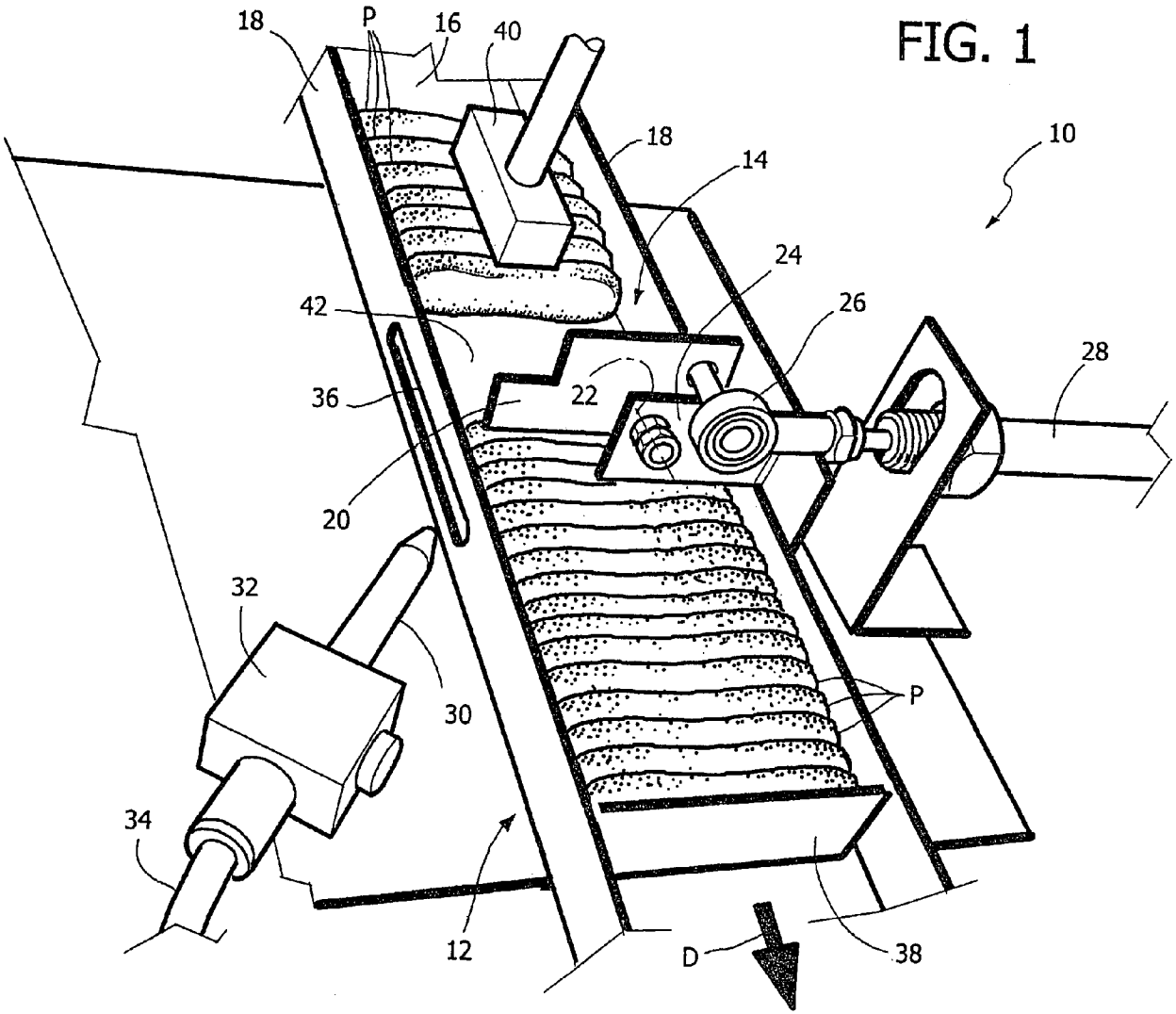
FIGS. 1 through 3 are schematic views illustrating the operating sequence of a device according to the present invention.

FIGS. 1 through 4 schematically show a part of a system for conveying products, in particular for an automatic packaging installation able to form packaged articles formed by groups of products set mutually side by side with the same dimension in the direction of mutual approach of the products.

In the figures, the reference number 10 designates a device able to form groups of products, stacked or set side by side with the same dimension in the direction of stacking or mutual approach. The groups of products downstream of the device 10 are fed to an automatic packaging machine (not shown in the drawings) which, in known manners, individually packages the groups of products. The machine can be, for example, of the type currently known as "flow-pack" or "form-fill-seal" or "ffs".

The device 10 comprises a guide 12 defining a conveyance path along which a continuous array 14 of products P advances along a direction of conveyance D.

In the example of embodiment illustrated herein, which is in fact merely an example, the products P have a generically flattened shape with two main surfaces and are positioned in the guide 12 with the respective main surface in contact with each other and orthogonal to the direction of advance D.

Still in the illustrated example, the direction of advance D of the products P is inclined relative to a vertical plane. The guide 12 comprises a bottom wall 16 which extends according to a plane that is inclined relative to a vertical plane and two lateral walls 18 orthogonal to the bottom wall 16. In this case, the advance of the products P in the direction D takes place simply by gravity. However, the present invention is applicable even if the direction of advance D is different, e.g. horizontal. In this case, the products P advance under the action of a conveyor, for example a motorised belt forming the bottom wall of the guide.

The device 10 comprises a separator element 20 which is destined to be inserted in a predetermined area of the path of conveyance of the products P.

Figure 2:
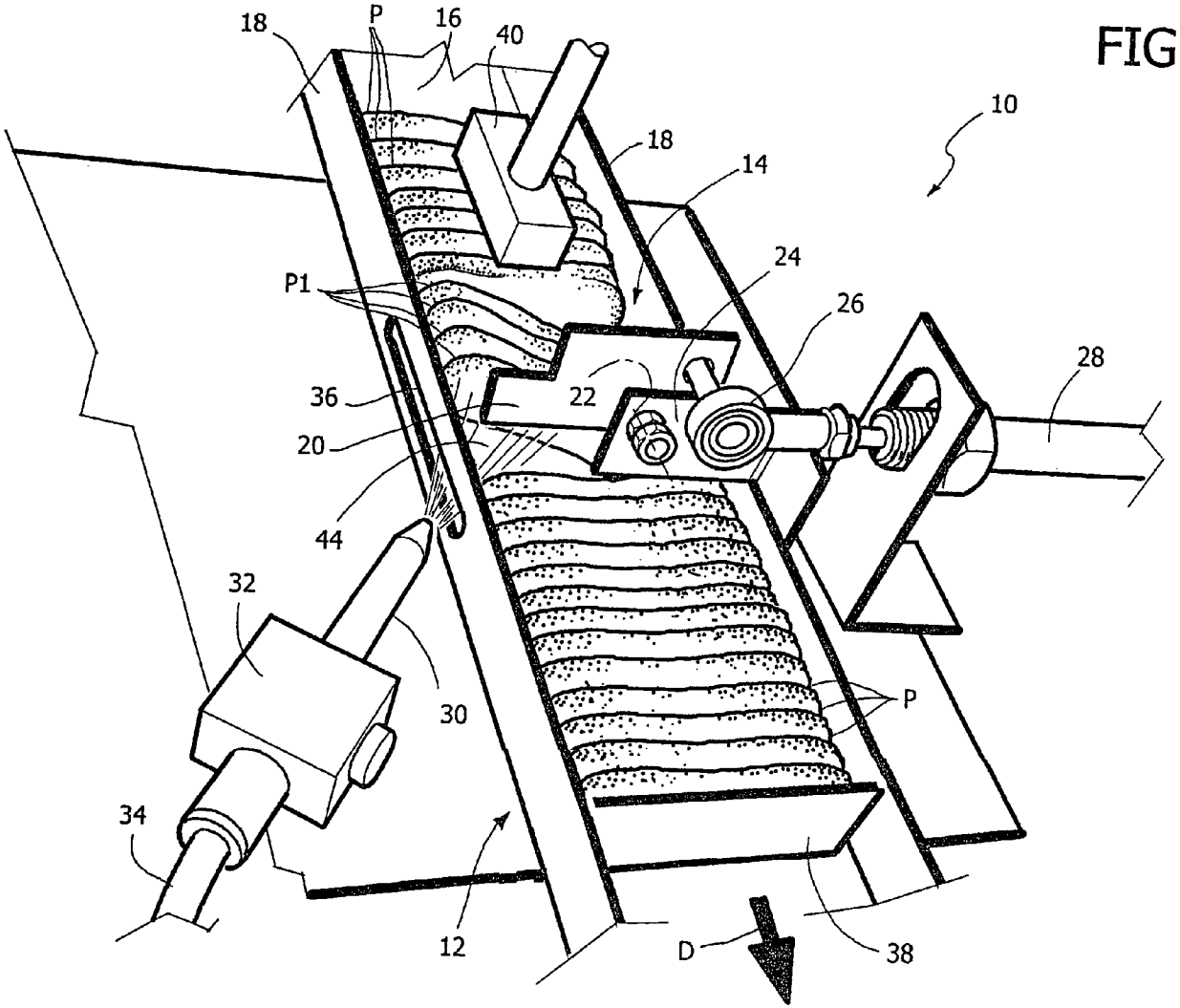
Figure 3:
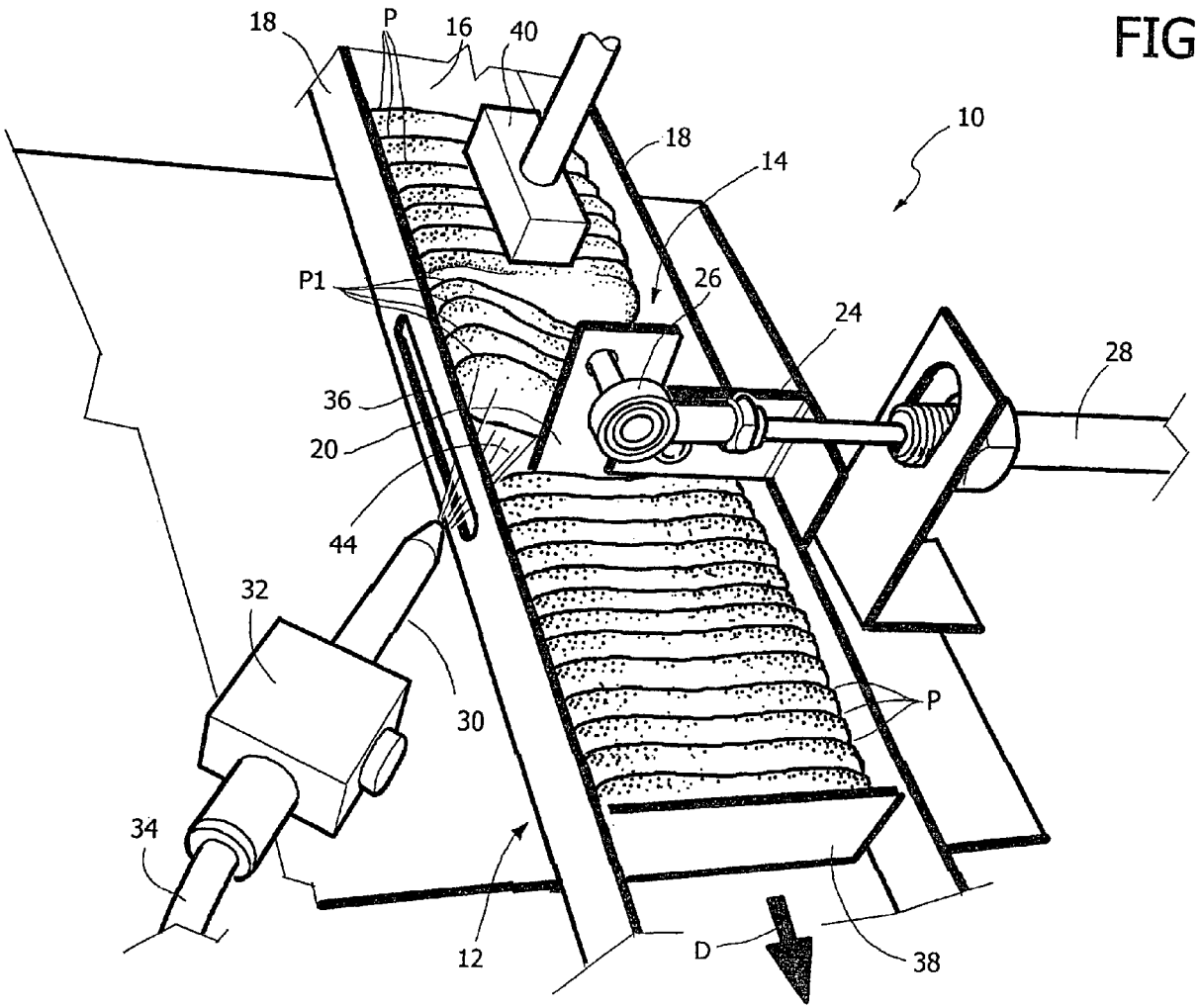

The separator element 20 is movable between an inoperative position illustrated in FIGS. 1 and 2 and an operative position illustrated in FIG. 3. In the illustrated example, the move from the inoperative position to the operative position is obtained by means of an oscillation around a stationary axis, parallel or substantially parallel to the direction D of conveyance of the products P.

In the embodiment illustrated by way of example in the drawings, the separator element 20 is articulated around an axis 22 to a plate 24 in fixed position relative to the guide 12. The separator element 20 is connected by means of an articulation 26 to an actuator 28 able to be operated selectively to move the separator element 20 from the inoperative position to the operative position and vice versa.

The device 10 comprises at least one nozzle 30 arranged to emit a jet of gas (typically air) directed towards the array of products P on the area of the conveyance path in which the separator element 20 is destined to be inserted. The nozzle 30 is associated to an electrical valve 32 and to a conduit 34 for feeding compressed gas.

Preferably, the nozzle 30 is positioned to emit the gas jet along a direction having at least one opposite component relative to the direction D of motion of the products P. In the illustrated example, the nozzle 30 is positioned to emit the gas jet on a side of the array of products and, for this purpose, a through slot 36 is provided on one of the lateral walls 18 of the guide 12. The slot 36 extends at the area of insertion of the separator element 20.

Downstream of the separator element 20 (with reference to the direction of advance of the products) the array of the products 14 bears against a support element 38, movable relative to the guide 12. In the schematic representation of FIGS. 1 through 3, the support element 38 is formed by a plate which could be a blade of a blade portioning device. In the position of reception of a group of products P, the support element 38 is distanced from the separator element 20 in the direction of advance of the products of a quantity equal to the desired length of the groups (or "slugs") of products to be packaged.

In preferred fashion, the device 10 further comprises a retaining device able to hold the array of products upstream of the separator element 20. This retaining device can, for example, be in the form of a shoe 40 that presses on the upper part of the array of products P.

The operation of the device according to the invention is as follows.

In the configuration of FIG. 1, the separator element 20 is in the raised and inoperative position, the support element 38 is stationary in a position of reception of the group of products in proximity to the separator element 20 and the solenoid valve 32 which feeds compressed air to the nozzle 30 is shut. The shoe 40 moves from the stop position which prevents the advance of the array of products to the open one, which allows the advance of the array of products that drop to bear on the portioning device 38. The portioning device 38 starts a downwards displacement, bringing with it the array of products and stopping in such a position that its distance from the separator 20 is slightly lower than the dimension of the portion to be separated. The shoe 40 drops to bear down on the array of products and prevents the subsequent downstream advance of the array of products located upstream thereof. The products P downstream of the shoe 40 form a continuous array 14 which bears on the support element 38 and which extends beyond the separation element 20, i.e. forming a group with a length that surely exceeds the desired length of the groups of products to be packaged. The support 38 moves farther downstream and an empty space 42 is thus formed between the array of products 14 which bears against the support element 38 and the array of products held by the shoe 40.

In this condition, the solenoid valve 32 is opened and the device assumes the configuration shown in FIG. 2. The products P1 which are hit by the jet gas are separated from the group of products P situated downstream of the separator element 20. In the example illustrated in FIG. 2, the products P1 are arranged in an inclined configuration relative to the direction of advance D. Between the products P1 and P, an empty space 44 is formed for the insertion of the separator element 20. It can be noted that the empty space 44 has a substantially triangular space with the maximum amplitude in the point in which the separator element 20 is inserted by effect of the rotating motion around the axis 22.

FIG. 3 illustrates the separator element in the operative position in which it is inserted in the path of conveyance of the products. In this position, the group of products P situated between the separator element 20 and the support element 38 is physically separated from the flow of products upstream of the separator element 20 and it has the length to be obtained for the finished packages.

Creating an empty space for the insertion of the separator element 20 by means of a jet of compressed air prevents any risk of rupture of the products due to the insertion of the separator element 20 in the path of conveyance of the products.

After the insertion of the separator element 20 as shown in FIG. 3, the group of products P with predetermined length is fed to a packaging station. Then, the portioning device 38 rises again near the separator element 20 which is then raised, the solenoid valve 32 is shut and the shoe 40 is raised to allow the advance of the array of products. The device returns to the configuration shown in FIG. 1 and the cycle repeats in identical fashion.

The method for the formation of groups, described above, can be used with various kinds of products, to be packaged singly or in groups. This method is particularly advantageous for oven-baked products such as biscuits or the like with irregular surfaces or with variable thickness.

The method according to the present invention is particularly advantageous when the products have substantially shell-like shape, i.e. with a main concave surface and a corresponding main convex surface. In this case, the products penetrate at least partially in each other when they are set side by side or stacked with the main surfaces in mutual contact. In this situation, it would be particularly difficult to insert a separation element into a continuous array of products whilst avoiding the rupture of the products.

In the particular case of products with concave or convex main surfaces, for process reasons it may be convenient for the products to advance along the path of conveyance with their convex surface oriented in the direction of advance. On the other hand, products of this type normally exit a cooking oven on a planar conveyor with their concave surface oriented downwards and their convex surface oriented upwards. Consequently, it may be necessary to provide for upsetting the products upstream of the device for the formation of groups of products, described above.

Figure 4:
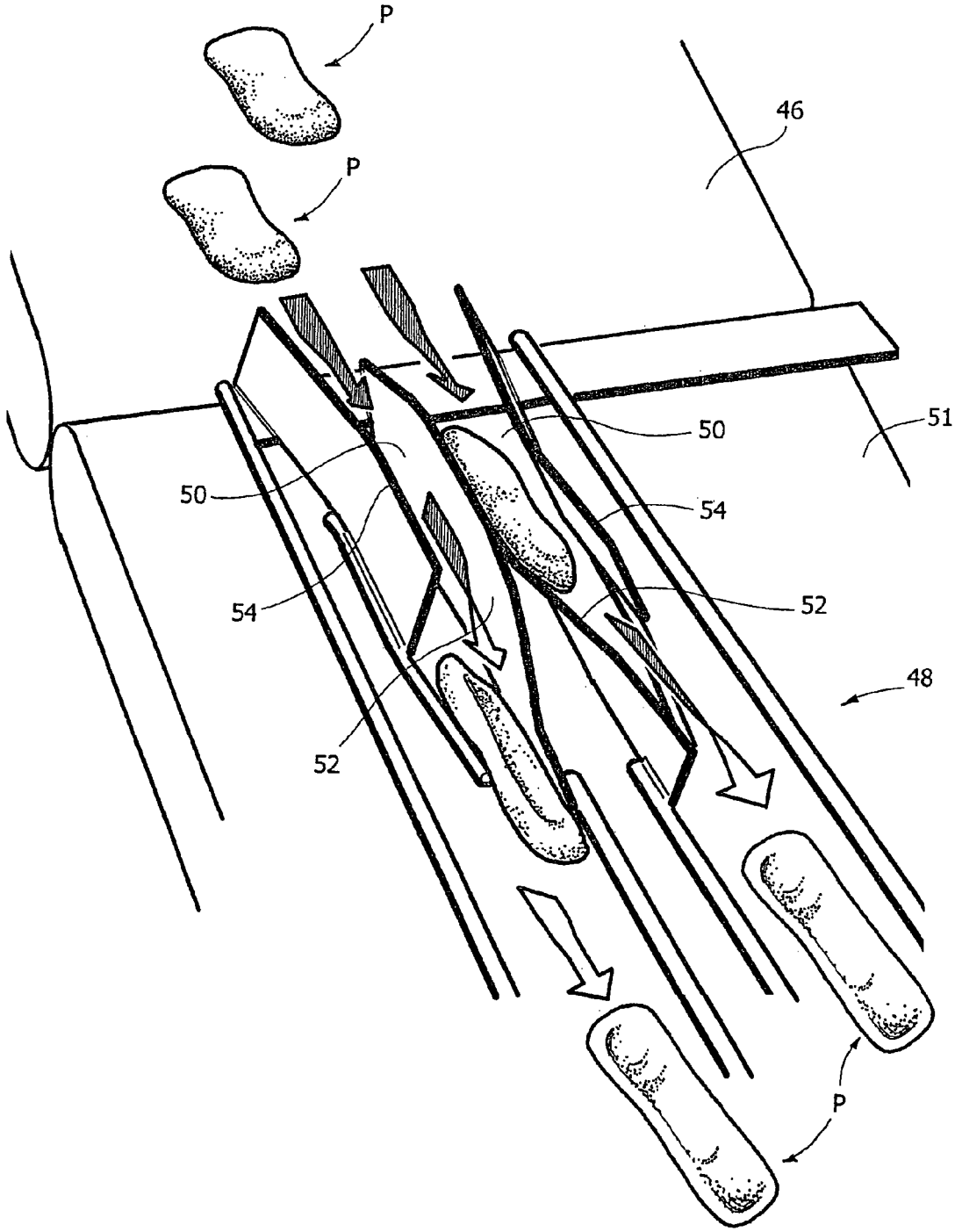
FIG. 4 is a perspective schematic view illustrating a device for upsetting products which can be positioned upstream of the device illustrated in FIGS. 1 through 4.

FIG. 4 schematically shows an assembly for upsetting the products, suitable for this purpose. With reference to FIG. 4, the products P advance on a horizontal conveyor 46 with their concave surfaces oriented downwards and are fed, for example on two parallel rows, to an upsetting device 48. Said device comprises two stationary parallel channels 50 and a conveyor 51 which forms the bottom wall of the channels 50. Each of the channels 50 has a roughly helical surface 52 facing a containment surface 54. The shape of the surfaces 52, 54 is such that the products P which enter the channels 50 rotate by 180° around their own longitudinal axis as they advance on the conveyor 51 in the direction indicated by the arrows. Upon exiting the upsetting device 48, the products P are arranged with their concave surface oriented upwards.

Naturally, without altering the principle of the invention, the construction details and the embodiments may be varied, even to a significant extent, relative to what is described and illustrated herein, without thereby departing from the scope of the present invention as defined in the appended claims.

The invention claimed is :

1. A device for forming groups of products in conveyance systems, comprising:

a conveyance structure configured to advance an array of products in mutual contact along a direction of conveyance, said direction of conveyance of the products being inclined relative to a vertical plane, such that said products advance along said conveyance structure under the action of gravity;

a separator element able to be inserted in a predetermined area of the conveyance structure to separate from the array a group of products with a predetermined dimension in the direction of conveyance, at least one nozzle capable of applying to the array of products at least one jet of gas to distance at least partially from each other the products in said predetermined area before the insertion of said separator element;

a support element downstream of the separator element, said support element configured to support a first array of products and moveable relative to the separator element at a distance corresponding to the desired length of the groups of products;

a retaining device upstream of the separator element, the retaining device being configured to hold a second array of products upstream of the separator element to inhibit movement of the second array toward the first array; and wherein, in use, an empty space is formed by the at least one jet of gas between the first array of products which bears against the support element and the second array of products held by the retaining device.

2. Device as claimed in claim 1, wherein said nozzle is arranged to emit said at least one jet of gas along an inclined direction relative to the direction of conveyance of the products, the inclined direction having at least one component opposite to the direction of conveyance of the products.

3. Device as claimed in claim 1, wherein the separator element can be oriented between an inoperative position and an operative position around an axis substantially parallel to the direction of conveyance of the products.

4. Device as claimed in claim 1, wherein said conveyance structure comprises a guide having two parallel lateral walls, at least one of said lateral walls being provided with a through opening facing said nozzle.

5. Device as claimed in claim 1, comprising a device for upsetting the products positioned upstream of said conveyance path.

6. Device as claimed in claim 5, wherein said device for upsetting the products comprises at least one channel with stationary lateral surfaces and with a conveyor forming a bottom wall of said at least one channel, said lateral surfaces being shaped in such a way as to produce an upsetting of the products around their longitudinal axis by effect of their displacement along said channel.

7. A method for forming groups of products in conveyance systems comprising the steps of:

making an array of products along a conveyance path with the products in contact with each other, emitting a jet of gas on the array of products in a predetermined area to distance the products at least partially from each other;

inserting a separator element in a predetermined area of the conveyance path and separating a group of products downstream of the separator element with predetermined length in the direction of advance;

advancing the products under the action of gavity along a path inclined relative to a vertical plane;

supporting a first array of products downstream of the separator element, at a distance corresponding to the desired length of the groups of products;

holding a second array of products upstream of the separator element and inhibiting movement of the second array toward the first array; and forming an empty space between the first array of products and the second array of products by the jet of gas.

8. Method as claimed in claim 7, wherein said jet of gas is inclined relative to the direction of advance of the products, with at least one component directed in the opposite sense relative to said direction of advance.

9. Method as claimed in claim 7, comprising the step of receiving said array of products by means of an element able to be positioned at a distance relative to the separator element that is close to the desired length of the groups of products.

10. Method as claimed in claim 7, comprising the step of holding the array of products upstream of the separator element.

11. Method as claimed in claim 7, wherein the separator element is inserted in the path of conveyance of the products by a rotation around an axis parallel to the direction of the conveyance of the products.

12. Method as claimed in claim 7, comprising the step of emitting said jet of gas in correspondence with a through opening formed in a lateral wall of said conveyance path.

13. Method as claimed in claim 7, wherein the conveyance path of the products extends in a plane that is inclined relative to a vertical plane.

14. Method as claimed in claim 7, comprising the step of upsetting the products before conveying them in a continuous array.

15. Method as claimed in claim 14, wherein the upsetting of the products is obtained by advancing the products in at least one stationary channel with walls shaped in such a way as to produce the upsetting of the product by effect of their advance.

16. A device for forming groups of products in conveyance systems, comprising:

a conveyance structure configured to advance an array of products in mutual contact along a direction of conveyance, a separator element able to be inserted in a predetermined area of the conveyance structure to separate from the array a group of products with a predetermined dimension in the direction of conveyance, and at least one nozzle capable of applying to the array of products at least one jet of gas to distance at least partially from each other the products in said predetermined area before the insertion of said separator element; and wherein said conveyance structure comprises a guide having two parallel lateral walls, at least one of said lateral walls being provided with a through opening facing said nozzle.

17. A device for forming groups of products in conveyance systems, comprising:

a conveyance structure configured to advance an array of products in mutual contact along a direction of conveyance, a separator element able to be inserted in a predetermined area of the conveyance structure to separate from the array a group of products with a predetermined dimension in the direction of conveyance, and at least one nozzle capable of applying to the array of products at least one jet of gas to distance at least partially from each other the products in said predetermined area before the insertion of said separator element;

a device for upsetting the products positioned upstream of said conveyance path; and wherein said device for upsetting the products comprises at least one channel with stationary lateral surfaces and with a conveyor forming a bottom wall of said at least one channel, said lateral surfaces being shaped in such a way as to produce an upsetting of the products around their longitudinal axis by effect of their displacement along said channel.

18. A method for forming groups of products in conveyance systems comprising:

making an array of products along a conveyance path with the products in contact with each other, inserting a separator element in a predetermined area of the conveyance path and separating a group of products downstream of the separator element with a predetermined length in the direction of advance, and emitting a jet of gas on the array of products in said predetermined area to distance the products at least partially from each other before inserting said separator element; and emitting said jet of gas in correspondence with a through space opening formed in a lateral wall of said conveyance path.

19. A method for forming groups of products in conveyance systems comprising:

making an array of products along a conveyance path with the products in contact with each other, inserting a separator element in a predetermined area of the conveyance path and separating a group of products downstream of the separator element with a predetermined length in the direction of advance, and emitting a jet of gas on the array of products in said predetermined area to distance the products at least partially from each other before inserting said separator element; and upsetting the products before conveying the products in a continuous array; and wherein the upsetting of the products is obtained by advancing the products in at least one stationary channel with walls shaped in such a way as to produce the upsetting of the product by effect of their advance.

20. A device for forming groups of products in conveyance systems, comprising:

a conveyance structure configured to advance an array of products in mutual contact along a direction of conveyance, said direction of conveyance of the products being inclined relative to a vertical plane, such that said products advance along said conveyance structure under the action of gravity;

a separator element able to be inserted in a predetermined area of the conveyance structure to separate from the array a group of products with a predetermined dimension in the direction of conveyance, and at least one nozzle capable of applying to the array of products at least one jet of gas to distance at least partially from each other the products in said predetermined area before the insertion of said separator element.

* * * * *

UNITED STATES PATENT AND TRADEMARK OFFICE

CERTIFICATE OF CORRECTION

PATENT NO. : 7,198,146 B2
APPLICATION NO. : 11/182431
DATED : April 3, 2007
INVENTOR(S) : Dario Guidetti It is certified that error appears in the above-identified patent and that said Letters Patent is hereby corrected as shown below:

Col. 6, line 1,delete “a predetermined area” and replace with --said predetermined area--

Col. 6, line 3, insert --a-- before “predetermined”

Col. 6, line 5, delete “gavity” and replace with --gravity--.

Signed and Sealed this

Thirty-first Day of July, 2007

JON W. DUDAS
*Director of the United States Patent and Trademark Office*